United States Patent [19]

Takahashi et al.

[11] 4,091,627

[45] May 30, 1978

[54] SYSTEM AND EQUIPMENT FOR OPERATING SELF-ADVANCING SUPPORTS

[75] Inventors: Ken Takahashi; Hideo Inoue, both of Tokyo, Japan

[73] Assignee: Taiheiyo Engineering Inc., Tokyo, Japan

[21] Appl. No.: 750,782

[22] Filed: Dec. 15, 1976

[30] Foreign Application Priority Data

Aug. 14, 1976 Japan ..... 51/96730

[51] Int. Cl.[2] ..... E21C 35/24; F01B 25/26

[52] U.S. Cl. ..... 61/45 D; 91/1

[58] Field of Search ..... 61/45 D, 85; 91/1, 170 R, 91/170 MP

[56] References Cited

U.S. PATENT DOCUMENTS

| | | | |
|---|---|---|---|
| 3,207,041 | 9/1965 | Philips | 61/45 D X |
| 3,259,024 | 5/1966 | Kibble et al. | 61/45 D X |
| 3,495,499 | 2/1970 | Ward | 61/45 D X |
| 3,643,445 | 2/1972 | Schmidt | 61/45 D |

*Primary Examiner*—Jacob Shapiro

*Attorney, Agent, or Firm*—Frank J. Jordan

[57] ABSTRACT

System and equipment for operating self-advancing supports comprising electromagnetic valves being provided in each of the self-advancing supports which support the roof of a long-walled pit face in a coal mine and rendering operative the hydraulic cylinders for causing the roof plates of the supports to be lowered and lifted and for causing the supports to move toward the pit face, and operating devices being connected to the electromagnetic valves through a cable wherein the electromagnetic valves can be opened and closed through the operating devices from a desired position remote from the supports so as to operate the supports.

12 Claims, 5 Drawing Figures

SYSTEM AND EQUIPMENT FOR OPERATING SELF-ADVANCING SUPPORTS

The present invention relates to a system and equipment for operating a group of self-advancing supports which are used to prevent the roof of a long-walled pit face in a coal mine from falling down, and more particularly an a system and equipment for operating a group of self-advancing supports intended to secure the safety and health of a operator who operates the group of self-advancing supports.

Each of the self-advancing supports comprising a group thereof has been conventionally operated directly by an operator and since the operating devices are arranged directly on the self-advancing supports, he has been forced to be always near the self-advancing support to be operated, thus causing him to lose his health because of inspiration of dust and to be always in danger of being hurt by falling rocks due to an accident.

Further, when the pit face is narrow, he has also been forced to assume an extremely difficult posture so as to operate the self-advancing supports directly, thus causing the operation efficiency to be lowered.

The present invention is intended to eliminate the above-mentioned drawbacks. It is, therefore, an object of the present invention to provide a system and equipment for operating a group of self-advancing supports from a desired position remote from the supports without causing the supports to be wrongly operated.

Another object of the present invention is to provide a system and equipment for operating the group of self-advancing supports intended to secure the safety and health of an operator who operates the supports.

These and other objects as well as merits of the present invention will be apparent from the following detailed description with reference to the accompanying drawings.

Figure 1:
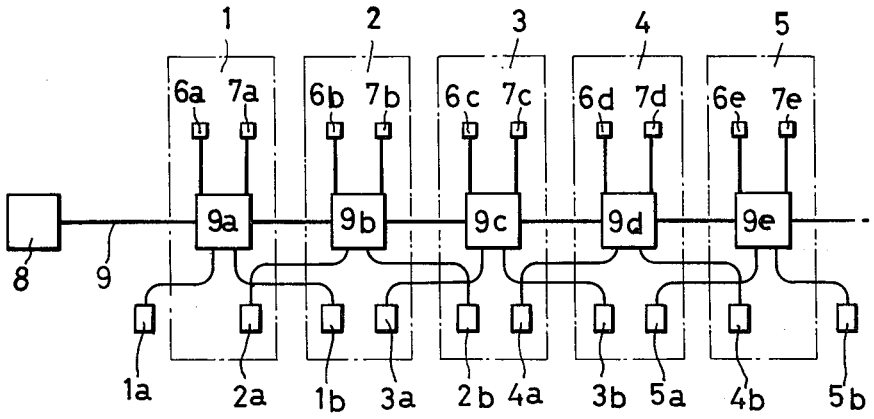
Figure 2:
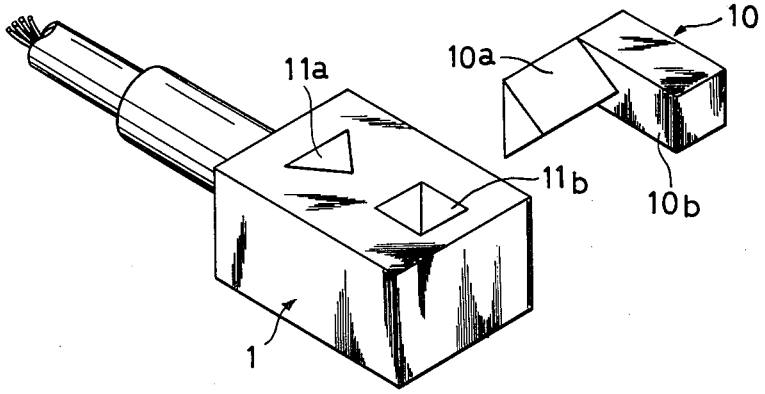
Figure 3:
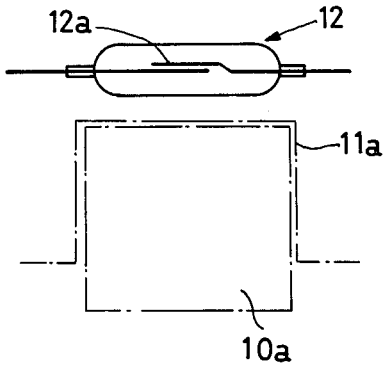
Figure 4:
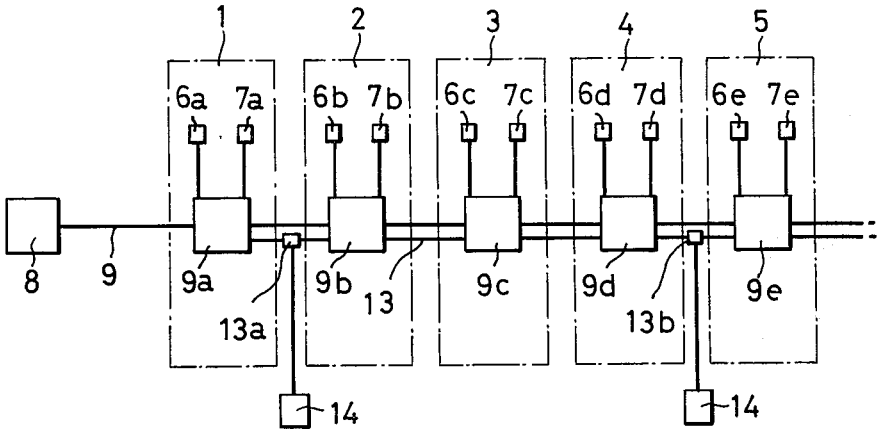
Figure 5:
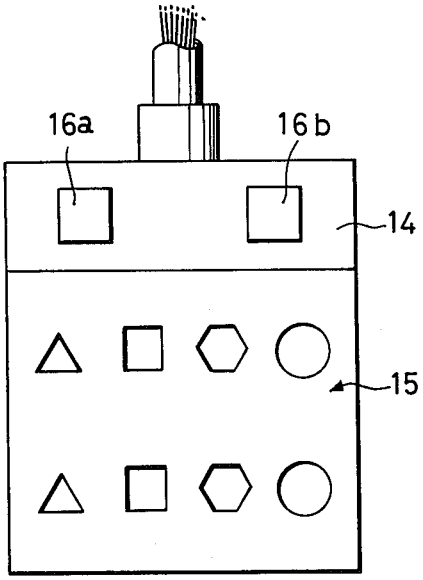

FIGS. 1–3 show an embodiment of the present invention, in which FIG. 1 is a block diagram showing the embodiment, FIG. 2 is an isometric view showing an operating device and FIG. 3 is a sectional view showing a magnetism detector; and FIGS. 4 and 5 show another embodiment of the present invention, in which FIG. 4 is a block diagram showing the embodiment and FIG. 5 is a plane view showing an operating device.

FIGS. 1 through 3 show an embodiment of the present invention, in which numerals 1–5 represent self-advancing supports, 6*a*–6*e* and 7*a*–7*e* electro-magnetic valves, and 1*a*, 1*b*, 2*a*, 2*b*, 3*a*, 3*b*, 4*a*, 4*b*, 5*a*, and 5*b* operating devices. Numeral 8 denotes a power source box, from which a cable 9 extends to connect each of the electromagnetic valves through couplers 9*a*14 9*e*.

Generally speaking, each of the self-advancing supports includes at least two kinds of hydraulic cylinders, one for supporting the roof plate of the support which supports the roof of the pit face in a coal mine and the other for serving as a shifter to cause the support to move toward the pit face. These two kinds of hydraulic cylinders enable the roof plate of the self-advancing support to be lowered and lifted and the support to move toward the pit face. Therefore, each of the self-advancing supports needs at least two electromagnetic valves, for example, electromagnetic valves 6*a*–6*e* for causing the hydraulic cylinder to lower the roof plate of the support and to move the support toward the pit face, and electromagnetic valves 7*a*–7*e* for causing the other hydraulic cylinder to lift the roof plate of the support. FIG. 2 is an isometric view showing an operating device 1 and an operating key 10 for opening and closing the electromagnetic valves.

The operating key 10 which is made of a permanent magnet comprises a triangle pole 10*a* and a rectangle pole 10*b* as shown in FIG. 2. This difference in the shapes of the poles is intended to cause two kinds of operations of each of the self-advancing supports to be attained with certainty. It is not essential for the poles to be formed integral with each other, but it may be that two kinds of the operating keys are differently provided. Two kinds of these operating keys correspond to the kinds of the electromagnetic valves provided in each of the self-advancing supports, for example, the operating key 10*a* being used to operate the electromagnetic valves 6*a*–6*e* which cause the hydraulic cylinders to lower the roof plates of the self-advancing supports and to move the supports toward the pit face, and the operating key 10*b* being used to operate the electromgnetic valves 7*a*–7*e* which cause the hydraulic cylinders to lift the roof plates of the self-advancing supports. There are provided in the upper face of the operating device 1 holes 11*a* and 11*b* having the same shapes as those of the operating key 10, and there is also provided in the inside of each of the holes a magnetism detector. The operating device 1 is so densely molded including the insides of the holes 11*a* and 11*b* that it can be protected from the falling rocks due to an accident and that wrong operation of the self-advancing supports due to dust in the coal mine can be prevented to the greatest extent. It is necessary that the holes 11*a* and 11*b* are provided with a certain space therebetween so as not to cause the magnetism detector provided in one of the holes to be mistakenly operated when the operating key is fitted into the other hole. There is employed as the magnetism detector such a switch 12 as shown in FIG. 3, the switch 12 being constructed so that when the operating key 10*a* is inserted into the hole 11*a* a movable contact 12*a* is drawn toward the key by the magnetic force of the key to set the switch "ON".

Each each of the self-advancing supports is provided with two operating devices. For example, the electromagnetic valves 6*b* and 7*b* of the self-advancing support 2 can be opened and closed by means of either of the operating devices 2*a* or 2*b* which are provided in the self-advancing supports 1 and 3, respectively, adjacent to the support 2. This is intended to allow the operator to freely select his position according to the moving direction of the shearer arranged in front of the self-advancing supports and also according to the wind in the coal mine. When the air in the coal mine flows, for example, from left to right in FIG. 1, he can operate the operating device provided in the support arranged on the left side of the one to be operated for the purpose of avoiding inspiration of dust in the coal mine.

In addition to the embodiment as described above, the present invention includes the following embodiments.

1. An embodiment in which each of the self-advancing supports is provided with a single operating device and the line extending from the operating device to the coupler provided on the support to be operated is made longer so as to enable the operator to operate the support from a desired position remote from the support.

2. An embodiment in which an electric circuit is set "ON" or "OFF" using the electromotive force of a piezo-element so as to close and open the electromagnetic valves and a special key, for example, as shown in FIG. 2 is used to render operative the piezo-element housed in the operating device.

3. An embodiment in which each group of the self-advancing supports is operated through a common operating device. Though each of the self-advancing supports is provided with a single or plural operating device (s) in the above mentioned embodiments, each group of the self-advancing supports is provided with a common operating device in this last embodiment. FIGS. 4 and 5 show this embodiment, in which none of the self-advancing supports 1–5 is provided with the operating device, and, parallel to the cable 9 extending from the power source box 8 to connect the electromagnetic valves 6*a*–6*e* and 7*a*–7*e* through the couplers 10*a*–10*e*, is arranged an operating cable 13, to which operating devices 14 and 14 are connected through couplers 13*a* and 13*b*.

As shown in FIG. 5, the operating device 14 comprises a key board 15 for specifying the self-advancing supports and switches 16*a* and 16*b* for specifying the electromagnetic valves. There are provided in two rows in the upper face of the key board 15 holes the same as those shown in FIG. 2, and the self-advancing supports amounting to 16 units can be selected by the combination of these holes. Numerals 16*a* and 16*b* represent the switches for specifying the electromagnetic valves, respectively, the one 16*a* being used to cause the roof plates of the self-advancing supports to be lowered and the supports to be moved toward the pit face, and the other 16*b* being used to cause the roof plates of the supports to be lifted again. The operating device 14 arranged to each group of the self-advancing supports permits the operator to operate any of the supports belonging to the group from a safe position where he can watch the support to be operated. It is possible in this embodiment to use, instead of a operating keys, the push button type which has push buttons representing from 0 to 9 and which is now used in calculating machines. It is also possible that the matrix circuit system is used to make the number of operating wires covered in the operating cable as few as possible.

As described above, the present invention allows the operator to easily operate any of the self-advancing supports from a desired position remote from the support to be operated, with the result that he can secure his health and safety from dust and any accident of falling rocks in the coal mine and that he can easily operate the self-advancing supports even in a narrow space where the conventional direct operation of the supports was difficult.

What is claimed is:

1. Apparatus for operating self-advancing mine roof supporting systems which includes a plurality of support plate means each operated by hydraulic cylinder means for vertically moving and advancing the support plate means, the combination comprising a plurality of electromagnetic valves controlling the operation of said hydraulic cylinder means, interconnecting means interconnecting said hydraulic cylinder means and said electromagnetic valves such that the latter are remotely located relative to said hydraulic cylinder means to thereby provide for remote operation of said hydraulic cylinder means by said electromagnetic valves, said electromagnetic valves comprising key-operated operating devices operable by one or more manually manipulated operating keys, said key-operated operating devices having a plurality of key-receiving means of different geometrical configuration such that each key-receiving means is operable by an operating key of the same geometrical configuration.

2. Apparatus according to claim 1, wherein each of said key-receiving means is defined by an opening for receiving said operating key, said key-operated operating device being operated by inserting the respective operating key into said opening.

3. Apparatus according to claim 1, wherein each of said support plate means is operated by a single key-operated operating device.

4. Apparatus according to claim 1, wherein said key-operated operating device comprises a plurality of key-receiving means of different geometrical configuration for controlling a plurality of support plate means.

5. Apparatus according to claim 4, wherein at least one of said key-receiving means on one of said key-operated operating devices selects a selected support plate means to be operated and the other key-receiving means on said one key-operated operating device operates the selected support plate means for said vertical and advancing movement thereof.

6. Apparatus according to claim 5, wherein at least some of said key-receiving means are arranged in rows on said key-operated operating devices.

7. Apparatus according to claim 1, wherein said key-operated operating device comprises magnetism-detection switch means actuated by said operating key, said operating key being permanently magnetized.

8. Apparatus according to claim 7, wherein said magnetism-detection switch means comprises a piezo element, whereby the electromotive force of said piezo element opens and closes the electromagnetic valve means.

9. Apparatus according to claim 1, wherein each of said support plate means is selectively operated by at least two key-operated operating devices, one of the last said two key-operated operating devices being located upstream of the direction of advance of the particular support plate being controlled thereby, the other of said two key-operated operating device being located downstream of the direction of advance of said particular support plate being controlled thereby.

10. Apparatus according to claim 1, wherein said interconnecting means comprises couplers coupled between said electromagnetic valves and said hydraulic cylinder means.

11. Apparatus according to claim 1, wherein said hydraulic cylinder means for operating each support plate means comprises two hydraulic cylinders, one hydraulic cylinder for lowering and advancing the support plate means and the other hydraulic cylinder for raising the support plate means, said plurality of electromagnetic valves comprising two electromagnetic valves for operating each support plate, one for operating each of said hydraulic cylinders.

12. Apparatus according to claim 1, wherein said operating key is integrally formed with a plurality of geometrical configurations, whereby a single operating key is operable to operate a plurality of key-receiving means.

* * * * *